United States Patent [19]

Twiehoff et al.

[11] Patent Number: 4,524,460

[45] Date of Patent: Jun. 18, 1985

[54] VALVED SACK

[75] Inventors: Karl-Heinz Twiehoff, Rheine; Reinhard Nowag, Georgsmarienhütte, both of Fed. Rep. of Germany

[73] Assignee: Windmoller & Holscher, Lengerich, Fed. Rep. of Germany

[21] Appl. No.: 579,710

[22] Filed: Feb. 13, 1984

[30] Foreign Application Priority Data

Feb. 14, 1983 [DE] Fed. Rep. of Germany ..... 3305087
Apr. 11, 1983 [DE] Fed. Rep. of Germany ..... 3312925

[51] Int. Cl.[3] ..... B65D 30/24

[52] U.S. Cl. ..... 383/45; 383/48; 383/51; 383/52; 383/44

[58] Field of Search ..... 383/44, 45, 48, 51, 383/52

[56] References Cited

U.S. PATENT DOCUMENTS

| | | | |
|---|---|---|---|
| 2,651,451 | 9/1953 | Bennett | 383/51 |
| 3,040,967 | 6/1962 | Klein | 383/52 |
| 3,482,762 | 12/1969 | Jones | 383/48 |
| 3,833,166 | 9/1974 | Murray | 383/44 |
| 3,937,395 | 2/1976 | Lawes | 383/45 |
| 4,073,429 | 2/1978 | Lawes | 383/44 |

FOREIGN PATENT DOCUMENTS

| | | | |
|---|---|---|---|
| 1001873 | 8/1965 | United Kingdom | 383/44 |
| 1061973 | 3/1967 | United Kingdom | 383/48 |

*Primary Examiner*—Stephen P. Garbe
*Attorney, Agent, or Firm*—Fleit, Jacobson, Cohn & Price

[57] ABSTRACT

A sack is constructed from a thermoplastic film of which the side portions are brought into partial overlapping relationship to define a tube section and top and bottom weld seams are applied transversely. A longitudinal weld seam applied within the confines of the region of overlap terminates at a spacing from the top weld seam to define a filling valve passage. The region of overlap contains a longitudinal inner strip of reduced thickness made in one piece with the walls of the sack.

15 Claims, 7 Drawing Figures

VALVED SACK

The invention relates to a valved sack.

In a valved sack of this kind known from GB-PS No. 956 599, the thermoplastic film is of single ply having a thickness and stiffness according to the desired strength of the sack. Thus, since the film must have a thickness corresponding to the required strength of the sack, the inner strip of the covered marginal zone of the film does not exhibit sufficient flexibility, softness and resilience to enable a properly closable valve flap or lip to be formed. As a consequence, the valve of the sack known from GB-PS No. 956 599 does not produce an adequate seal.

To achieve an adequate strength for the walls of the valved sack on the one hand and provide a properly closable pliable and flexible valve flap on the other hand, the plastics film in a valved sack known from CA-PS No. 984 346 is folded to form a double-layer semi-tube, wherein the inner layer of the covered marginal zone of the tube section formed after folding so projects beyond the outer layer that it forms a properly closable valve strip of sufficient width. Such valved sacks can be produced only with valve closure flaps of which the thickness corresponds to one layer of the two layers of the sack walls, the desired width of the strip forming the valve flap being produced and maintained by appropriately folding the semi-tube or cutting the open edges of the semi-tube.

In a valved sack of the aforementioned kind known from US-PS No. 38 33 166, a strip of plastics film is inserted beneath the covered marginal zone, the inner marginal zone of the strip projecting beyond the covered marginal zone and forming the valve flap. The inserted film strip is, by means of one of the two longitudinal weld seams, welded to the overlapping marginal zones and, by means of the other longitudinal weld seam, only to the covered marginal zone. This known valved sack is comparatively expensive to produce insofar as a special film strip has to be inserted.

It is the problem of the invention to provide an easily producible valved sack in which, independently of the thickness of the load bearing walls of the sack, the application of additional film strips is not necessary even though a good sealing effect is produced in the valve region.

The valved sack according to the invention is therfore in its simplest form produced from a single layer of plastics film which has been extruded in such a way that it has a thinner zone of a thickness corresponding to the desired thickness of the valve flap. Since such plastics films are conventionally produced on blown film extruders in the form of tubes, these tubes can be extruded with a thinner zone of a width equal to twice the width of the strips of reduced thickness, so that the tubes can be severed into webs by cutting them open centrally symmetrically to the thinner zone, the tube sections being severed from the webs after a tube has been formed.

In a further embodiment of the invention, the plastics film is made in two layers by folding it to a semi-tube and is provided with two inner strips of reduced thickness in registry with each other. Such plastics films can be made in that the tube produced by the blowing process is flattened symmetrically to its thinner zone and the folded edge passing centrally through the thinner zone is cut open.

The plastics film may consist of a flattened tube having two strips of reduced thickness and in registry with each other in the region of its covered marginal zone. Such a plastics film is simply made in that the tube extruded with a thinner zone is flattened symmetrically to this thinner zone.

The width of each strip of reduced thickness preferably amounts to from one half to two thirds of the length of overlap. From the longitudinal weld seams which define the tube sections, one seam extends through the overlapping marginal zones of equal thickness and the other into the region of the covered strip of reduced thickness. The overlapping marginal zones are located beyond the centre of the flattened valved sack. The valved sack itself may be made as a flat sack or be provided with said folds.

Desirably, the strip of reduced thickness is provided in the region of the inner opening of the valve passage with short freely terminating and transversely extending incisions. Preferably, one incision is provided at each of the upper and lower end of the valve passage.

A connecting seam or spot welds may be provided between the upper ends of the longitudinal weld seam or seams that form the lower edge of the valve passage.

The upper edge of the valve passage can be formed by two short weld seams which extend into the top weld seam and are aligned with the longitudinal weld seams.

The longitudinal weld seams are preferably interrupted in the region of the base weld seam to form ventilating apertures.

In a further embodiment of the invention, a label corresponding to the width of the valve passage is inserted therein. The inner marginal zone of the label is folded onto itself about a line parallel to the longitudinal weld seams, the folded-over marginal zone being coated on the outside with a pressure-sensitive adhesive and bonded to the inner wall of the covering marginal zone or preferably to the outside of the covered marginal zone in the vicinity of the opening of the valve passage. This label is so long that, after filling, it projects from the valve passage and can be peeled off in such a way that the pressure-sensitive adhesive coating remains on one marginal zone of the mouth of the valve passage. By means of pressure, the strip of reduced thickness forming the covered marginal zone can then be adhered with the superposed wall of the sack so that, after filling, the sack will not leak in the region of its valve.

Desirably, the label is a separating label, preferably of a silicon basis, so that the pressure-sensitive adhesive will be properly released therefrom upon peeling off and the label will also prevent welding of the overlapping zones when forming the longitudinal weld seams in the valve passage zone. During formation of the tube, the labels can be readily inserted by the overlapping turning-in of the side zones of the web of plastics film in the region of the subsequent valve passages before the longitudinal weld seams are formed and the tube sections are severed.

Examples of the invention will now be described in more detail with reference to the drawing, wherein.

Figure 1:
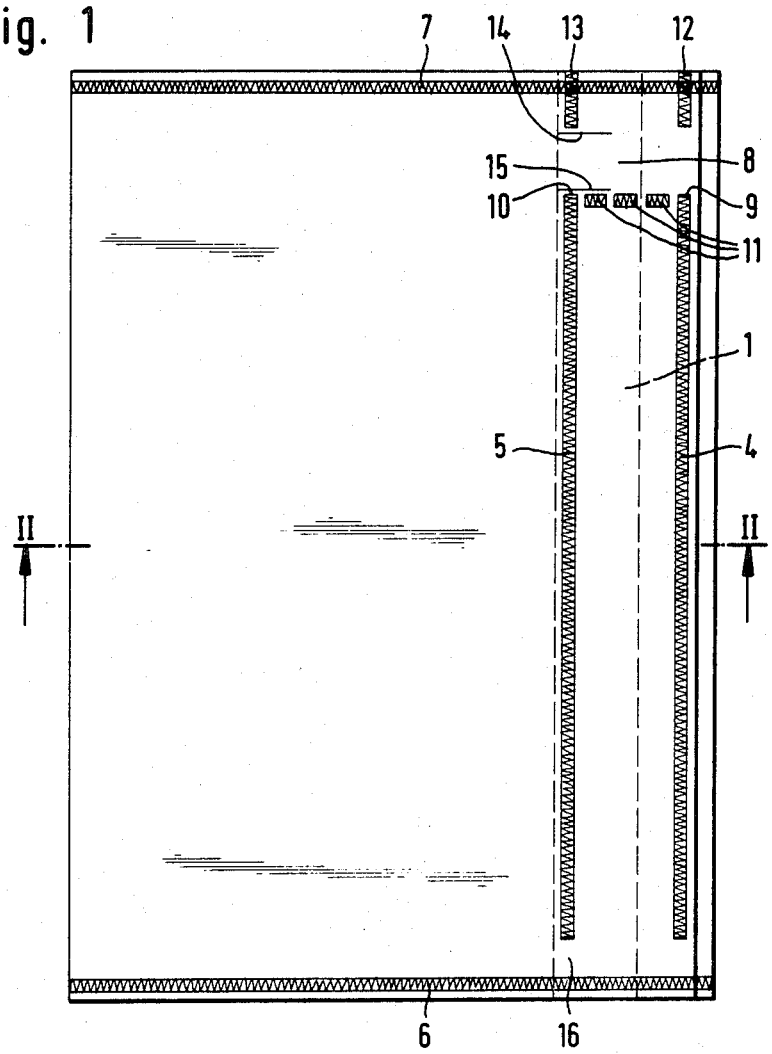
FIG. 1 is a plan view of a valved sack consisting of one layer of plastics film.

The flattened valved sack shown in FIG. 1 has been welded off from a tubular web that was formed from a web of material by the overlapping turning-over of its lateral zones. The single-ply web of material comprises an inner longitudinally extending strip of reduced thickness 1. This strip 1 forms the inner marginal strip of the inwardly folded marginal zone 2 which is partially covered by the inwardly folded marginal zone 3. The overlapping inwardly folded marginal zones 2, 3 from the front of the valved sack. The overlapping zones of the folded-over marginal zones 2, 3 are interconnected by the longitudinally extending weld seams 4, 5. The weld seam 4 extends parallel to the outer sack edge in the region of the overlapping marginal zones of equal thickness whereas the longitudinal weld seam 5 is located in the region of the marginal strip of reduced thickness. The longitudinal weld seam 5 extends at a spacing from the inner edge of the strip of reduced thickness 1. The tube sections are closed to form valved sacks by means of the base weld seam 6 and the top weld seam 7. The longitudinally extending weld seams 4, 5 terminate at a spacing from the top weld seam 7, which corresponds to the width of the valve passage 8. On a line defined by the upper ends 9, 10 of the longitudinal weld seams 4, 5, spot welds 11 are applied which, together with the upper ends 9, 10 of the longitudinal weld seams 4, 5, bound the lower edge of the valve passage. Further, starting from the top weld seam 7 there may be short weld seams 12, 13 which are aligned with the longitudinal weld seams 4, 5 and bound the top of the valve passage 8.

The inner strip 1 of reduced thickness can, adjoining the ends of the longitudinal weld seam 5, and the short weld seam 13, be provided with short freely terminating incisions 14, 15 which cut a tongue out of the strip 1 to form an easily movable valve flap.

The longitudinal weld seams 4, 5 may terminate at a slight spacing in front of the base weld seam 6 to result in a gap 16 through which air may escape during filling.

Figure 3:
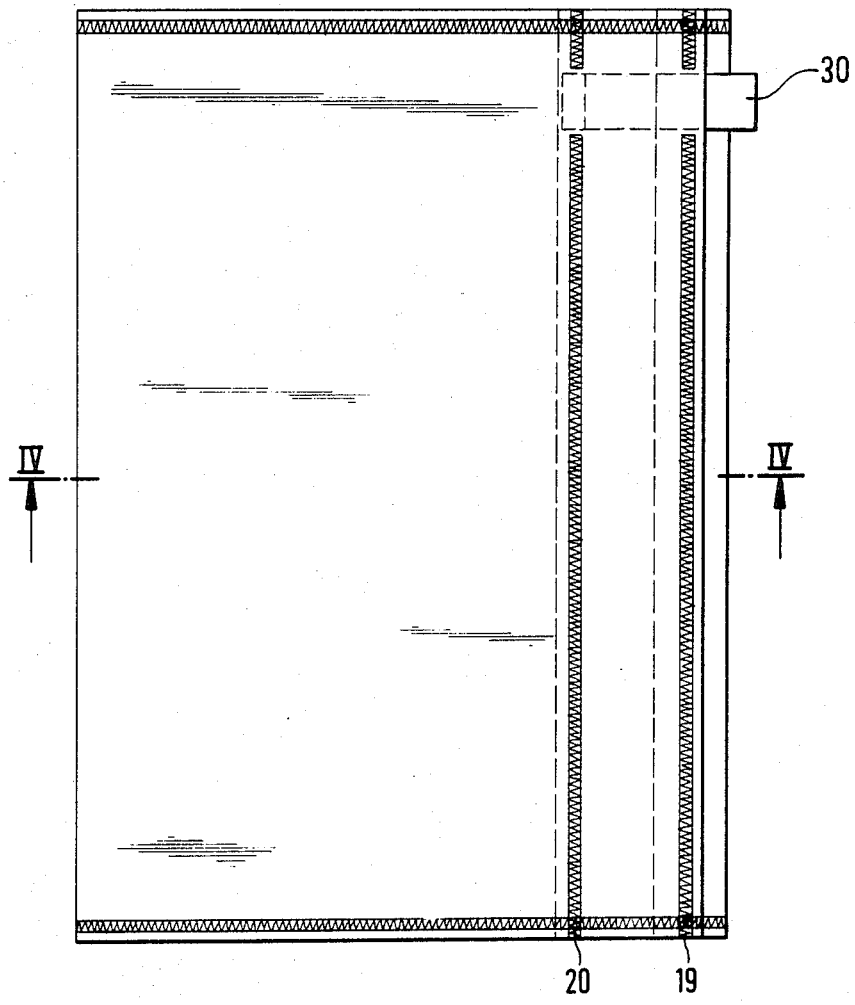
FIG. 3 is a plan view of a valved sack consisting of a double layer of plastics film folded to form a semi-tube, including an adhesive applying label.
Figure 4:
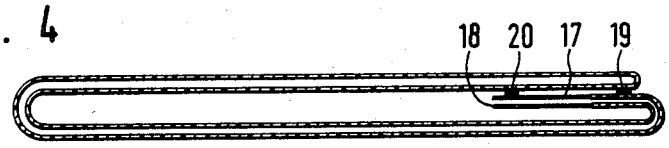
FIG. 4 is a section through the valved sack of FIG. 3 on the line IV—IV shown without the adhesive applying label shown in FIG. 3.

In the example of FIGS. 3 and 4, the web of material from which a tube of film is formed by turning the marginal zones inwardly consists of a flattened semi-tubular web of which the open edges are formed by aligned strips of reduced thickness. By turning the marginal zones inwardly, one obtains a two-ply tube of film from which tube sections or rather the valved sacks are welded off in the described manner. As is evident from FIG. 4, in this embodiment the inner longitudinally extending strip of reduced thickness is formed by the two overlapping strips 17, 18. The strips 17, 18 form the inner portion of the inwardly folded marginal zone which is covered by the other inardly folded marginal zone. The longitudinally extending weld seams 19, 20 may be passed through all four layers of the overlapping marginal zones or engage only the superposed layers. An adhesive applying label 30 is shown inserted in the valve passageway. The inner marginal zone of the label is folded onto itself about a line parallel to the longitudinal weld seams 19 and 20. The folded-over marginal zone is coated on the outside with a pressure sensitive adhesive and is bonded to the outside of the covered marginal zone in the vicinity of the opening of the valve passage. The label projects from the valve passage and can be peeled off so that the pressure sensitive adhesive coating remains on one marginal zone of the mouth of the valve passage. Pressure can then be applied to the valve passage to adhere the strip of reduced thickness to the opposed overlapping marginal zone.

Figure 5:
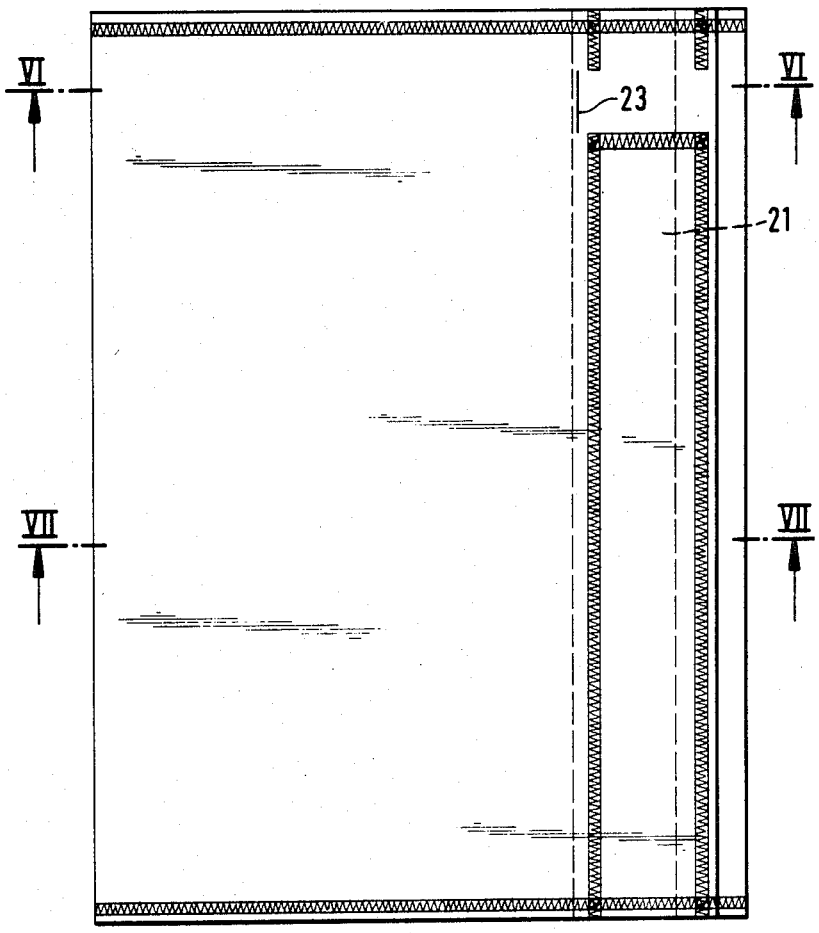
FIG. 5 is a plan view of a valved sack made from a plastics film consisting of a flattened tube.
Figure 6:
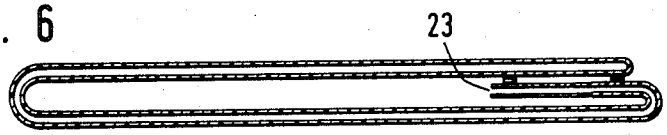
FIG. 6 is a section through the valved sack of FIG. 5 taken on the line VI—VI in FIG. 5.
Figure 7:
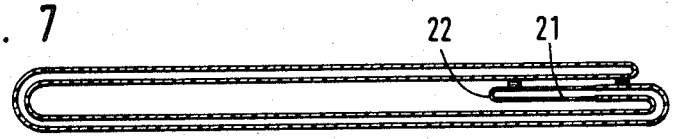
FIG. 7 is a section through the valved sack of FIG. 5 on the line VII—VII.

In the example of FIGS. 5 to 7, the tube from which the tube sections are severed is formed by a flattened tubular web by folding the side portions inwardly, the marginal zone of the lower inwardly turned portion being formed by a zone of reduced thickness through which one edge of the flattened tube extends centrally. The superposed zones of reduced thickness form the inner longitudinally extending strip 21 of the covered marginal zone of the two-ply web of plastics film formed by a flattened tube. The inner folded edge 22 passing centrally through the zone of reduced wall thickness is opened by an incision 23 in the region of the mouth of the valve passage to result in more readily movable valve flaps.

Figure 2:
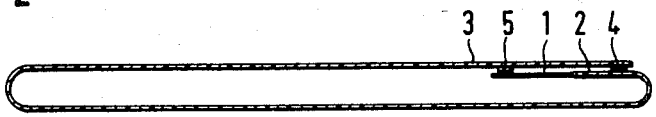
FIG. 2 is a section through the valved sack on the line II—II in FIG. 1.

Basically, the construction of the valved sacks according to FIGS. 3, 4 and 5 to 7 correspond to the valved sack of FIGS. 1 and 2, the only difference being that, instead of a single ply of web of film, one starts with a flattened semi-tube or a tube consisting of two layers of a web of film.

According to a further embodiment (not shown), the valved sack consists of a tube section with a longitudinally extending strip of reduced wall thickness which is folded inwardly to form a side fold, the inner folded edge of this side fold extending symmetrically to the strip of reduced thickness. The side fold is so deep that a narrow marginal strip remains between the inner region having a reduced wall thickness and the outer edges. This four-layer marginal strip has the greatest wall thickness whereas the inner portion of the side fold is formed by the strip of reduced wall thickness. By means of transversely welded separating seams, tube sections are severed from this tube having a side fold, this side fold having first been welded together through a longitudinally extending weld seam in the zone between the two outer edges of the side fold and its inner zone of reduced thickness. This weld seam terminates at a spacing from the top weld seam folded by one of the transverse weld seams of a width corresponding to the valve passage. In the region between the end of the longitudinal weld seam and the top weld seam, the inner edge of the side fold passing centrally through the strip of reduced wall thickness is cut open so that the cut edges form valve flaps.

Parallel to the outer longitudinal weld seam passing through the four-ply zone of the side fold having layers of equal thickness, there may be a second longitudinal weld seam of equal length which passes through the zone of the sack in which the inner side fold zone of reduced thickness is disposed. The upper ends of both parallel longitudinal seams define the start and end of the valve passage. The transverse line extending between these ends can be closed by a further weld seam. The line can also be fixed by one or several spot welds.

We claim:

1. A valved sack comprising:

a web of thermoplastic film, a first marginal zone defined by the web including a marginal strip, said marginal strip having a thickness less than the thickness of the remainder of said web, a second marginal zone defined by the web, said first marginal zone being laterally opposed to said second marginal zone, a tube section formed by said second marginal zone overlapping said first marginal zone, a top weld seam, a bottom weld seam, said top weld seam and said bottom weld seam extending transversely across said tube section to form said valved sack, a longitudinal weld seam joining said first marginal zone and said second marginal zone, one end of the longitudinal weld seam terminating spaced from said top weld seam, and a valve passage defined between the top weld seam and the end of the longitudinal weld seam spaced from the top weld seam, said valve passage being bounded by said second marginal zone and said marginal strip, said marginal strip bounding said valve passage being of reduced thickness for resiliently sealing said sack after said sack is filled through said filling valve passage.

2. A valved sack according to claim 1, characterised in that the tube section is a two-ply semi-tube and is provided with an additional marginal strip of reduced thickness aligned with said marginal strip.

3. A valved sack according to claim 1, characterised in that the tube section consists of a flattened tube comprising an additional marginal strip of reduced thickness located in the region of the overlapping first and second marginal zones.

4. A valved sack according to claim 3, characterised in that an inner folded edge of said two marginal strips being cut open in a region of the valve passage.

5. A valved sack according to claim 1, characterised in that the width of the marginal strip of reduced thickness is from one half to two thirds of the length of overlap of said first and second marginal zones.

6. A valved sack according to claim 1, characterised in that the marginal strip is provided in the region of an inner opening of the valve passage with short freely terminating transversely extending incisions.

7. A valved sack according to claim 6, characterised in that one incision is provided at each of the upper and lower ends of the valve passage.

8. A valved sack according to claim 1, characterised in that at least two longitudinal weld seams are provided and that a connecting seam is provided between the upper ends of the longitudinal weld seams that define the lower edge of the valve passage.

9. A valved sack according to claim 8, characterised in that the upper edge of the valve passage is formed by two short weld seams which extend into the top weld seam and are aligned with the longitudinal weld seams.

10. A valved sack according to claim 1, characterised in that the longitudinal weld seam is interrupted in the region of the bottom weld seam.

11. A valved sack according to claim 1, further comprising a label corresponding in width to that of the valve passage is inserted therein, an inner marginal zone of the label being folded over onto itself about a line parallel to the longitudinal weld seam, and that a pressure-sensitive adhesive is coated on the outside of the folded-over inner marginal zone and is adhered to one of an inner wall of the second marginal zone and an outside wall of the first marginal zone in a region of the mouth of the valve passage.

12. A valved sack according to claim 11, wherein the label consists of a separating label, preferably of silicon basis.

13. A valved sack comprising a tube section including a longitudinally extending strip of reduced wall thickness, a foldline defined by said strip, said strip being folded onto itself along said foldline, a first marginal zone defined by said tube section including said strip, a second marginal zone defined by said tube section including a side fold, said second marginal zone overlapping said first marginal zone, a top weld seam, a bottom weld seam, said top weld seam and said bottom weld seam extending transversely across said tube section, a longitudinal weld seam terminating at a distance from said top weld seam, said longitudinal weld seam being parallel to and spaced between the foldline of said strip and said side fold, and a valve passage, the width of said valve passage being defined by the separation between said top weld seam and said longitudinal weld seam, and the foldline of said strip being cut open in said valve passage.

14. A valved sack according to claim 13, further comprising a second longitudinal weld seam extending parallel to said longitudinal weld seam through a sack region in which the fold of reduced thickness is disposed and that the second longitudinal weld seam terminates at the same spacing front of the top weld seam as does said longitudinal weld seam.

15. A valved sack according to claim 14, wherein the ends of both parallel longitudinal weld seams are interconnected by a transverse weld seam to form the lower edge of the valve passage.

* * * * *